US005380158A

United States Patent [19]

Gerbitz

[11] Patent Number: 5,380,158

[45] Date of Patent: Jan. 10, 1995

[54] APPARATUS AND METHOD FOR HOLDING A SUMP PUMP

[76] Inventor: Daniel R. Gerbitz, 1432 S. Mosley, Wichita, Kans. 67211

[21] Appl. No.: 163,505

[22] Filed: Dec. 9, 1993

[51] Int. Cl.[6] ..... F04B 17/02

[52] U.S. Cl. ..... 417/40; 417/360; 417/423.3

[58] Field of Search ..... 417/40, 41, 360, 361, 417/423.3; 248/680, 507; 138/106, 107

[56] References Cited

U.S. PATENT DOCUMENTS

| | | | |
|---|---|---|---|
| 2,634,079 | 4/1953 | Surenda | 248/507 |
| 3,319,571 | 5/1967 | Schaefer | 417/40 X |
| 3,932,853 | 1/1976 | Cannon | 417/40 X |
| 3,999,890 | 12/1976 | Niedermeyer | 417/361 X |
| 4,392,790 | 7/1983 | Shibata et al. | 417/360 |
| 4,553,561 | 11/1985 | Morris | 417/40 X |
| 5,007,451 | 4/1991 | Bralich | 417/41 X |
| 5,076,762 | 12/1991 | Lykes et al. | 417/40 |
| 5,131,133 | 7/1992 | Peterson et al. | 248/680 X |
| 5,165,867 | 11/1992 | Dockery | 417/360 |

FOREIGN PATENT DOCUMENTS

| | | | |
|---|---|---|---|
| 1242443 | 8/1960 | France | 417/40 |

*Primary Examiner*—Richard E. Gluck
*Attorney, Agent, or Firm*—John Wade Carpenter

[57] ABSTRACT

A pump and a discharge assembly comprising a pump having a cylindrical neck with a cylindrical neck outer surface and coupled to a pump suction assembly. A cylindrical discharge conduit is provided with a cylindrical discharge conduit outer surface and is coupled to the pump suction assembly for conducting water from a hole in a basement of a structure. A bracket is engaged to the cylindrical neck of the pump, and another bracket is engaged to the cylindrical discharge conduit. Each bracket has a structure defining a base plate with a plurality of apertures and a support neck bound to the base plate and has an inner arcuate surface. A pair of clamp members is provided. A method for installing a pump and discharge assembly for removing water from a sump hole in a basement of a structure.

5 Claims, 1 Drawing Sheet

APPARATUS AND METHOD FOR HOLDING A SUMP PUMP

FIELD OF THE INVENTION

This invention is related to an apparatus and method for holding a sump pump. More specifically, the present invention provides for a bracket and method for engaging a sump pump and discharge pipe assembly such that a pump suction assembly of the sump pump is elevated off a bottom of a sump hole in a basement of a structure, such as a residential house.

DESCRIPTION OF THE PRIOR ART

A patentability investigation was conducted and the following U.S. patents were discovered: U.S. Pat. Nos. 4,177,021 and 4,201,519, both to Niedermeyer; U.S. Pat. No. 4,392,790 to Shibata et al.; U.S. Pat. No. 4,661,047 to Weis; and U.S. Pat. No. 4,886,426 to Swinals. None of the foregoing prior art teaches or suggests the particular apparatus and method of the present invention.

SUMMARY OF THE INVENTION

The present invention accomplishes its desired objects by broadly providing a method for installing a pump and discharge assembly for removing water from a sump hole in a basement of a structure comprising the steps of:

(a) providing a structure having a base floor with a sump hole for collecting water and having a sump hole bottom;

(b) providing a pump having a cylindrical neck with a cylindrical neck outer surface and coupled to a pump suction assembly;

(c) providing a first support bracket having a structure defining a first base plate with a plurality of apertures and a first support neck bound to the first base plate and having a first inner arcuate surface;

(d) providing a cylindrical discharge conduit with a cylindrical discharge conduit outer surface;

(e) providing a second support bracket having a structure defining a second base plate with a plurality of apertures and a second support neck bound to the second base plate and having a second inner arcuate surface;

(f) securing the first base plate to the base floor;

(g) contacting the first inner arcuate surface against the cylindrical neck outer surface such that the pump section assembly is spaced from the sump hole bottom;

(h) circumscribing the cylindrical neck and the first support neck with a first clamp member for firmly securing the cylindrical neck to the first support neck of the first support bracket;

(i) coupling the cylindrical discharge conduit to the pump suction assembly;

(j) securing the second base plate to the base floor;

(k) contacting the second inner arcuate surface against the cylindrical discharge conduit outer surface; and (l) circumscribing the cylindrical discharge conduit and second support neck with a second clamp member for firmly securing the cylindrical discharge conduit to the second support neck of the second support bracket.

The present invention further accomplishes its desired objects by broadly providing a pump and discharge assembly comprising a pump having a cylindrical neck with a cylindrical neck outer surface and coupled to a pump suction assembly. A cylindrical discharge conduit with a cylindrical discharge conduit outer surface is coupled to the pump suction assembly for conducting water from a hole in a basement of a structure. A first support bracket is engaged to the cylindrical neck. The first support bracket has a structure defining a first base plate with a plurality of apertures and a first support neck bound to the first base plate and has a first inner arcuate surface flushed against the cylindrical neck outer surface. A first clamp member circumscribes the cylindrical neck and the first support neck for firmly securing the cylindrical neck to the first support neck of the first support bracket. A second support bracket is engaged to the cylindrical discharge conduit. The second support bracket has a structure defining a second base plate with a plurality of apertures and a second support neck bound to the second base plate and has a second inner arcuate surface flushed against the cylindrical discharge conduit outer surface. A second clamp member circumscribes the cylindrical discharge conduit and the second support neck for firmly securing the cylindrical discharge conduit to the second support neck of the second support bracket. The pump and discharge assembly additionally comprises a rod support member engaged to and supported by the cylindrical neck; and a pump rod slidably engaging the rod support member. A buoyant member is secured to a first end of the pump rod; and the pump has a pump switch engaged to a second end of the pump rod.

It is therefore an object of the present invention to provide a pump and discharge assembly and a method for installing a pump and discharge assembly for removing water from a sump hole in a basement from a sump hole in a basement of a structure.

These, together with the various ancillary objects and features which will become apparent to those skilled in the art as the following description proceeds, are attained by this novel apparatus and method for holding a sump, a preferred embodiment as shown with reference to the accompanying drawings, by way of example only, wherein;

DETAILED DESCRIPTION OF THE PRESENT INVENTION

Figure 1:
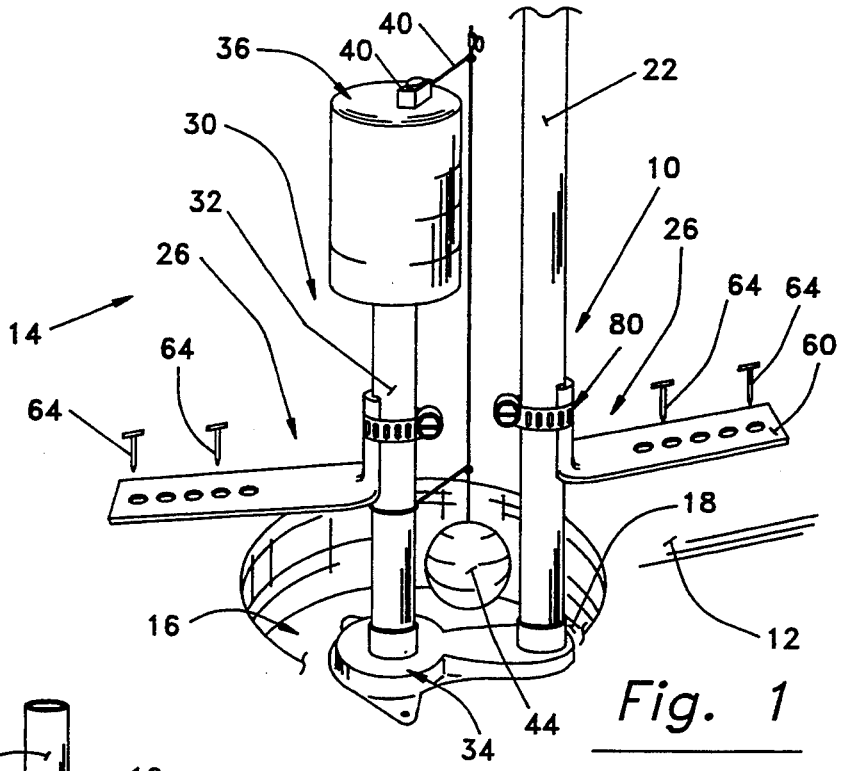
FIG. 1 is a perspective view of one embodiment of the present invention having an upright pump and a discharge assembly both engaged to the anchor or bracket of the present invention.
Figure 2:
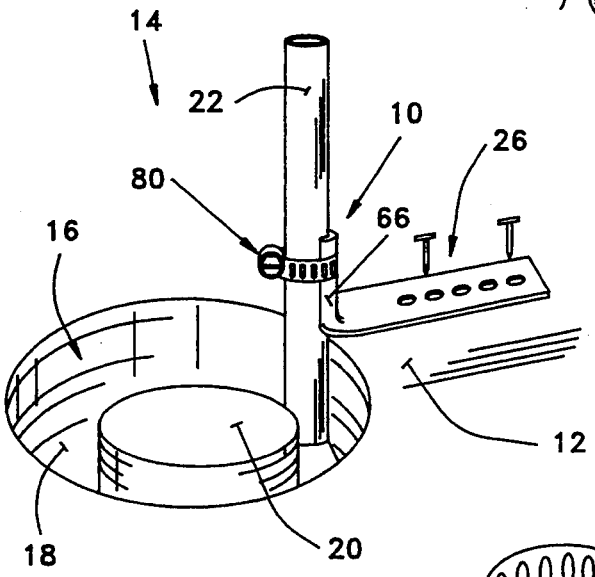
FIG. 2 is a perspective view of another embodiment of the present invention having a cylindrical discharge pipe engaged to a submersible pump, or the like, and which is further engaged to the anchor or bracket of the present invention.
Figure 3:
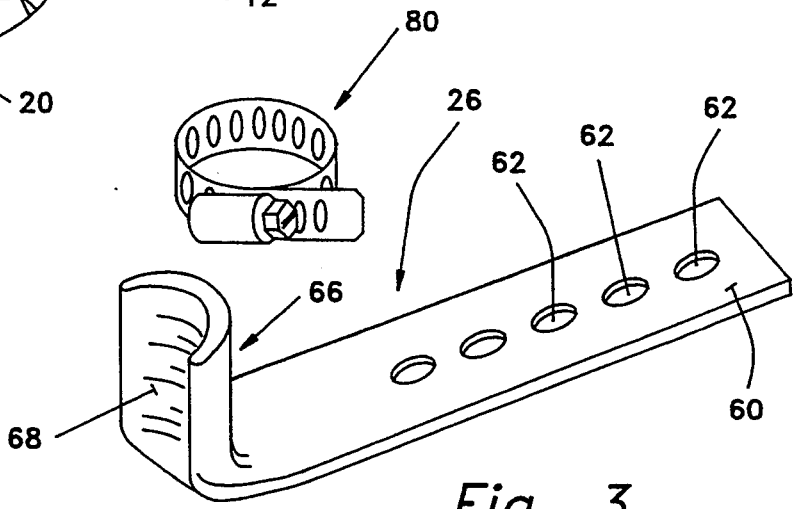
FIG. 3 is a perspective view of the anchor or bracket and the associated clamp.

Referring in detail now to the drawings, wherein similar parts of the invention are identified by like reference numerals, there is seen a pump and discharge assembly, generally illustrated as 10 in both FIGS. 1 and 2.

In both FIGS. 1 and 2 there is also seen a base floor 12 of a structure (e.g. a residential house, an office building, etc.), generally illustrated as 14. A sump hole 16 is or have been formed in the base floor 12. The sump hole 16 has a bottom 18 and is a conventional sump hole 16 for relieving pressure underneath the base floor 12 and collecting water to prevent flooding on the base floor 12. In FIG. 2 a submersible pump 20 is disposed in the sump hole. A discharge conduit 22 is coupled to the submersible pump 20. An anchor or bracket assembly 26 is engaged or otherwise coupled to the discharge conduit 22, and anchors or secures to or on the base floor 12.

In FIG. 1 there is further seen an upright pump 30 having a cylindrical neck 32, a pump suction assembly 34 secured to the cylindrical neck 32, and a pump head 36 also secured to the cylindrical neck 32. The pump head 36 has a pump switch 40 secured and coupled to the pump head 36. A pump rod 42 coupled to and secured to the switch 40. The pump rod 42 has a buoyant member 44 secured thereto for being raised and lowered by water that would seep into the sump hole 16. Obviously, if the buoyant member is raised to a certain point, the switch 40 is closed to activate the pump 30. A rod 48 is secured to the pump neck 32 and slidably engages the pump rod 42 for guiding the same. The discharge conduit 22 is secured to the pump suction assembly 34 wherethrough pumped water is passed. The bracket assembly 26 is also secured to the discharge conduit 22.

Each of the bracket assemblies 26–26 comprises a base plate 60 having a plurality of apertures 62 for receiving one or more screws/bolts 64 that anchor the base plate 60 to the base floor 12. A neck 66 is bound or integrally formed with the base plate 60. The neck 66 has an arcuate (or generally semi-circular) inner surface 68 which flushes against the discharge conduit and the cylindrical neck 32. A clamp 80 circumscribes the discharge conduit 22 and/or the cylindrical neck 32 to secure the base plate 60 and its associated neck 66 to the discharge conduit 22 and/or the cylindrical neck 32.

Thus, by the practice of the present invention, there is more particularly provided an anchor or bracket assembly 26 which is a novel and better way to anchor an upright 30 or submersible sump pump 20. The bracket 26 is made from steel, then zinc plated and comes with the clamp 80 to fit the ejection pipe 22 and/or upright shaft 32 on sump pump 30. The bracket 26 will suspend the upright sump pump 30 off the bottom 18 of the sump pit 16 away from the construction debris. The bracket 26 will give a professional look to any sump installation and will prevent potential problems that may occur.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for installing a pump and discharge assembly for removing water from a sump hole in a basement of a structure comprising the steps of:

(a) providing a structure having a base floor with a sump hole for collecting water and having a sump hole bottom;

(b) providing a pump having a cylindrical neck with a cylindrical neck outer surface and coupled to a pump suction assembly;

(c) providing a first support bracket having a structure defining a first base plate with a plurality of apertures and a first support neck bound to the first base plate and having a first inner arcuate surface;

(d) providing a cylindrical discharge conduit with a cylindrical discharge conduit outer surface;

(e) providing a second support bracket having a structure defining a second base plate with a plurality of apertures and a second support neck bound to the second base plate and having a second inner arcuate surface;

(f) securing the first base plate to the base floor:

(g) contacting the first inner arcuate surface against the cylindrical neck outer surface such that the pump section assembly is spaced from the sump hole bottom;

(h) circumscribing the cylindrical neck and the first support neck with a first clamp member for firmly securing the cylindrical neck to the first support neck of the first support bracket;

(i) coupling the cylindrical discharge conduit to the pump suction assembly;

(j) securing the second base plate to the base floor;

(k) contacting the second inner arcuate surface against the cylindrical discharge conduit outer surface; and (l) circumscribing the cylindrical discharge conduit and second support neck with a second clamp member for firmly securing the cylindrical discharge conduit to the second support neck of the second support bracket.

2. The method of claim 1 additionally comprising securing a rod member to the cylindrical neck; and slidably engaging a pump rod to the rod.

3. A pump and discharge assembly comprising a pump having a cylindrical neck with a cylindrical neck outer surface and coupled to a pump suction assembly; a cylindrical discharge conduit with a cylindrical discharge conduit outer surface and coupled to the pump suction assembly for conducting water from a hole in a basement of a structure; a first support bracket engaged to the cylindrical neck, said first support bracket having a structure defining a first base plate with a plurality of apertures and a first support neck bound to said first base plate and having a first inner arcuate surface flushed against the cylindrical neck outer surface; a first clamp member circumscribing the cylindrical neck and the first support neck for firmly securing the cylindrical neck to the first support neck of the first support bracket; a second support bracket engaged to the cylindrical discharge conduit, said second support bracket having a structure defining a second base plate with a plurality of apertures and a second support neck bound to said second base plate and having a second inner arcuate surface flushed against the cylindrical discharge conduit outer surface; a second clamp member circumscribing the cylindrical discharge conduit and the second support neck for firmly securing the cylindrical discharge conduit to the second support neck of the second support bracket.

4. The pump and discharge assembly of claim 3 additionally comprising a rod member engaged to and supported by the cylindrical neck; a pump rod slidably engaging the rod member; a buoyant member secured to a first end of the pump rod; said pump having a pump switch engaged to a second end of said pump rod.

5. A pump and discharge assembly comprising a submersible pump; a discharge conduit coupled to the submersible pump; and a support bracket engaged to the discharge conduit; said support bracket comprising a base plate having a plurality of apertures for receiving at least one bolt member to anchor the base plate to a floor; a neck integrally bound to the base plate, said neck having a structure defining an arcuate inner surface, said arcuate inner surface flushing against the discharge conduit; and a clamp circumscribing the discharge conduit and the neck for securing the support bracket to the discharge conduit.

* * * * *